US006435750B1

(12) United States Patent
Serna

(10) Patent No.: US 6,435,750 B1
(45) Date of Patent: Aug. 20, 2002

(54) CLEANING BRUSH WITH DISPOSABLE CLEANING MEMBER

(76) Inventor: Josefina Angela Escajadillo Serna, Los Angeles, 6 - 5to A Barakaldo, 48903 Bizkaia (ES)

( * ) Notice: Subject to any disclaimer, the term of this patent is extended or adjusted under 35 U.S.C. 154(b) by 0 days.

(21) Appl. No.: 09/942,211

(22) Filed: Aug. 29, 2001

(30) Foreign Application Priority Data

Aug. 30, 2000 (ES) ..... 200002232

(51) Int. Cl.[7] ..... B43M 11/06
(52) U.S. Cl. ..... 401/183; 401/290; 401/282
(58) Field of Search ..... 401/6, 183, 184, 401/185, 270, 280, 282

(56) References Cited

U.S. PATENT DOCUMENTS

| | | | | |
|---|---|---|---|---|
| 2,522,617 A | * | 9/1950 | Ijams | 401/183 |
| 2,743,042 A | * | 4/1956 | Burgin | 401/183 |
| 4,222,676 A | * | 9/1980 | Roth | 401/28 |
| 4,867,593 A | * | 9/1989 | Kurokawa et al. | 401/186 |

FOREIGN PATENT DOCUMENTS

| | | | |
|---|---|---|---|
| ES | U9401245 | 10/1994 | A47K/11/10 |
| ES | U9802587 | 6/1999 | A47K/11/10 |
| ES | U9900696 | 1/2000 | A47K/11/10 |
| ES | U9901928 | 5/2000 | A47K/11/10 |

* cited by examiner

*Primary Examiner*—David J. Walczak
(74) *Attorney, Agent, or Firm*—J. Sanchelima; A. Bordas

(57) ABSTRACT

A cleaning brush having a handle assembly and biodegradable cleaning member. The handle assembly is substantially a hollow cylinder housing a flexible container for a cleaning liquid and further including a cannula for dispensing liquid. The handle assembly includes an opening at one end, through which the container is refilled, and a cover to prevent the liquid from coming out. An engagement mechanism at the other end of the handle assembly includes two parallel stems with arrow heads at their distal ends that are cammingly inserted inside a cooperative opening in the cleaning member end releasably engaged therein. The stems are deflected, and the arrow heads disengaged through spring loaded actuators that protrude radially outwardly through the handle assembly

8 Claims, 2 Drawing Sheets

CLEANING BRUSH WITH DISPOSABLE CLEANING MEMBER

BACKGROUND OF THE INVENTION

1. Field of the Invention

The present invention relates to a cleaning brush with disposable cleaning member.

2. Description of the Related Art

Many designs for brushes exist and in particular for cleaning bathroom fixtures, such as toilets and bidets. These devices are either of the type that is reusable or disposable.

The reusable cleaning instruments have the drawback of being stored with the risk of carrying germs and bacteria. The disposable ones are obviously more expensive to use. The present invention has a disposable cleaning element thereby avoiding the risk of carrying germs while a user is able to reuse the refillable handle.

Applicant believes that the closest reference corresponds to Spanish Utility model U9401245 issued to Josep Folguera Obiol for a disposable cleaning brush where the entire brush is soluble in water in time, this invention is also the WIPO publication No. WO 9530366. Spanish Utility model U9901928 issued to Emilia Magnani Perez also describes a cleaning broom that is made out of cardboard but with a complete different structure. Furthermore, Spanish Utility model U9802587, also issued to Emilia Magnani Perez, disclosed a disposable cardboard spatula.

Finally, utility Model U9900696 issued to Eugenio Castro Casado disclosed a cleaning broom with an internal container for dispensing liquids through the bristle members.

However, they differ from the present invention because they all are totally disposable. The present invention is a combination of disposable and non-disposable elements. In the present invention the handle assembly is reusable.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a cleaning brush with a disposable cleaning member that can be readily mounted and unmounted.

It is another object of this invention to provide a cleaning brush with a disposable cleaning member that is biodegradable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
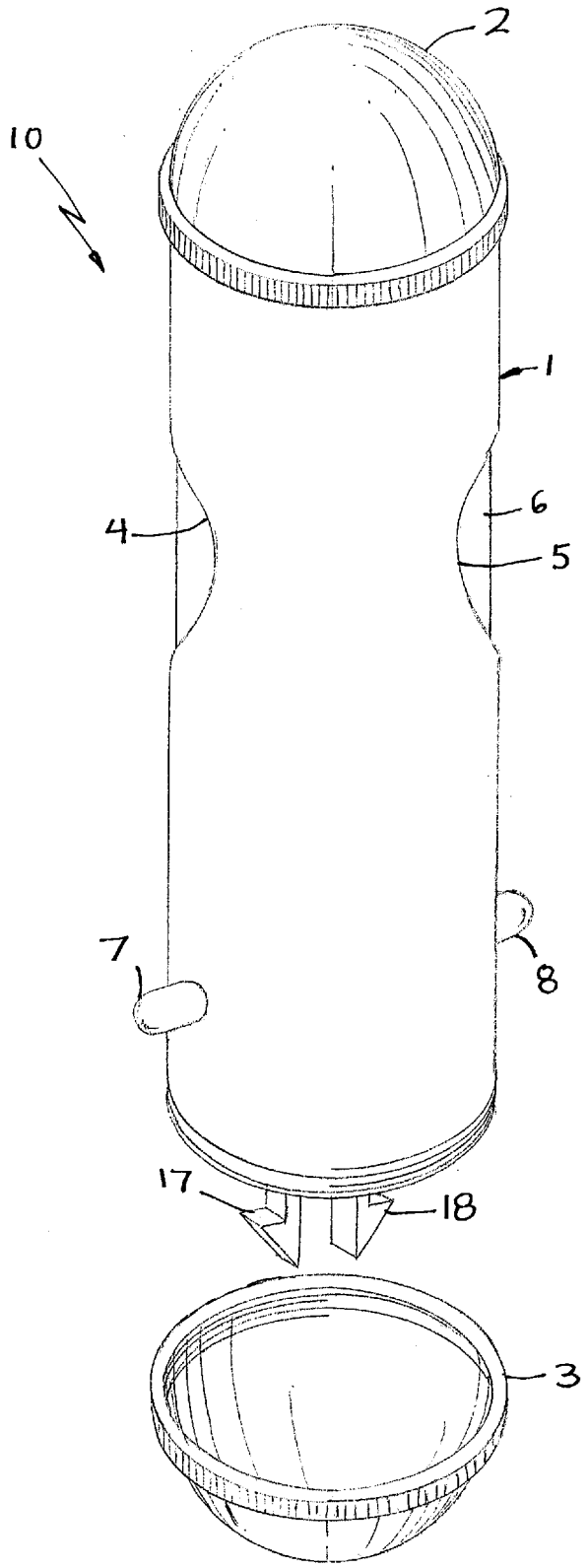
FIG. 1 represents an isometric view of the cleaning utensil subject of the present application with covers at both ends.

Referring now to the drawings, where the present invention is generally referred to with numeral 10, it can be observed that it basically includes a handle assembly 1, disposable cleaning member 20 that is removably mounted to one end of assembly 1 and two covers, 2 and 3, removably mounted to the end of handle assembly 1.

Figure 2:
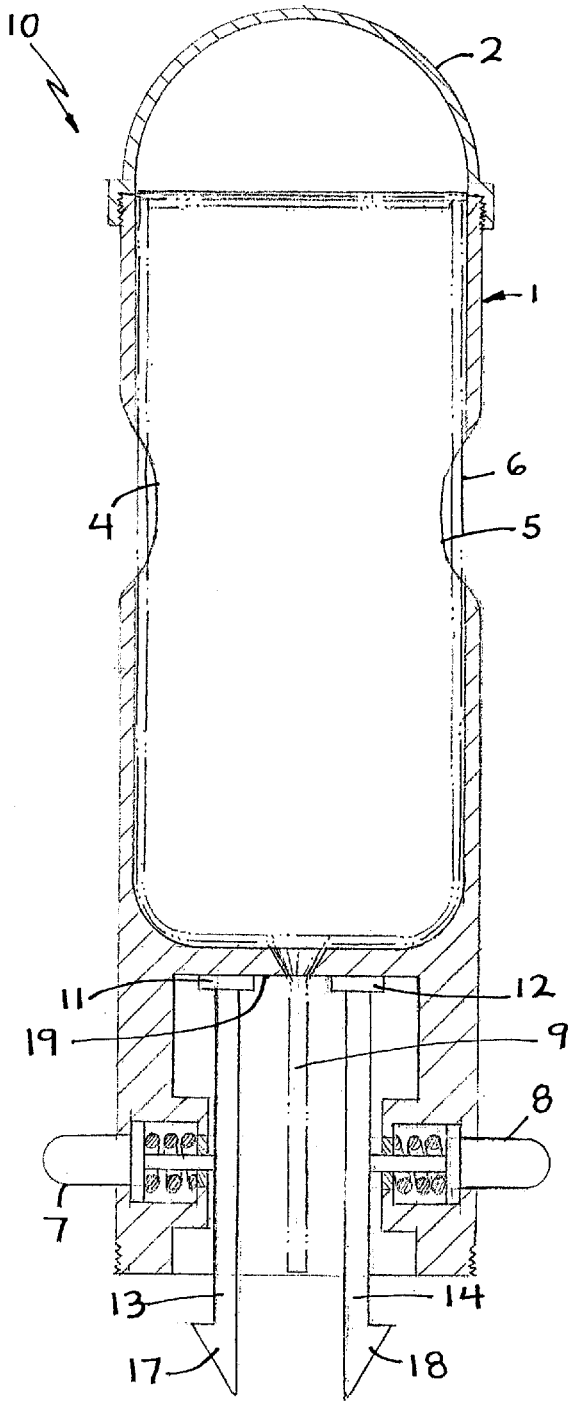
FIG. 2 is a representation a cross-sectional view of the utensil shown in the previous figure with the lower cover and the cleaning member removed to show the engaging mechanism.

In one of the preferred embodiments, handle assembly 1 has a cylindrically elongated shape with two ends. One of the ends removably receives cover 2 and the other end removably receives cover 3. Assembly 1 includes two lateral openings, 4 and 5, cooperatively positioned to ergonomically permit a user to use his/her fingers to press internal container 6 where the cleaning liquid is stored. Container 6 is flexible and is lined with or has cooperative dimensions to be mounted abuttingly against the internal walls of handle assembly 1 with the upper end open when cover 2 is not mounted. Container 6 can be refilled by removing cover 2. The lower end, as best seen in FIG. 2 includes cannula 9 through which the cleaning liquid exits container 6 to be applied on the area to be cleaned. Spring loaded buttons 7 and 8 protrude radically outwardly and they are designed to cooperatively actuate the engagement mechanism.

As shown in FIG. 2, container 6 has a cleaning liquid inside cylindrical handle assembly 1. Container 6 is made out of a flexible, deformable material that permits the cleaning liquid to come out. One of the preferred embodiments includes the use of spring loaded actuators or buttons 7 and 8 that releasably co-act with stems 13 and 14. Stems 13 and 14 include arrow head terminations 17 and 18 at the distal ends and their bases 11 and 12 are rigidly mounted to the bottom surface 19. A user presses in buttons 7 and 8 to deflect stems 13 and 14 that in turn cause arrow head terminations 17 and 18 to disengage from enlarged cooperative openings 17' and 18', respectively, at the bottom of central opening 20' of cleaning member 20. To engage terminations 17 and 18 with their respective cooperative openings 17' and 18', a user cammingly forces the former through central opening 20' until they engage with the latter.

Figure 3:
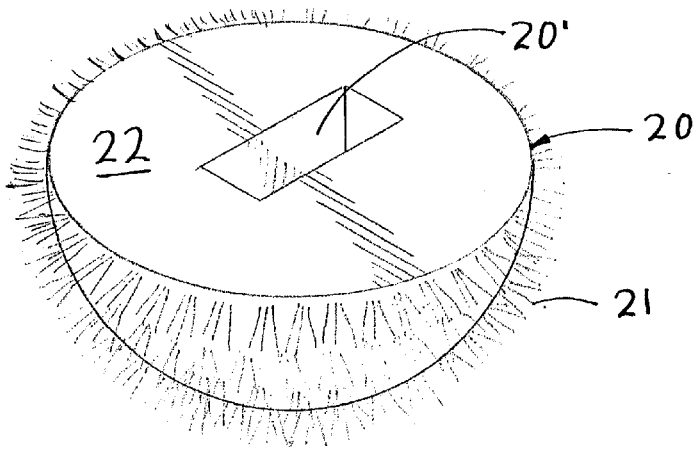
FIG. 3 illustrates one of the preferred embodiments for disposable and removable cleaning member.
Figure 4:
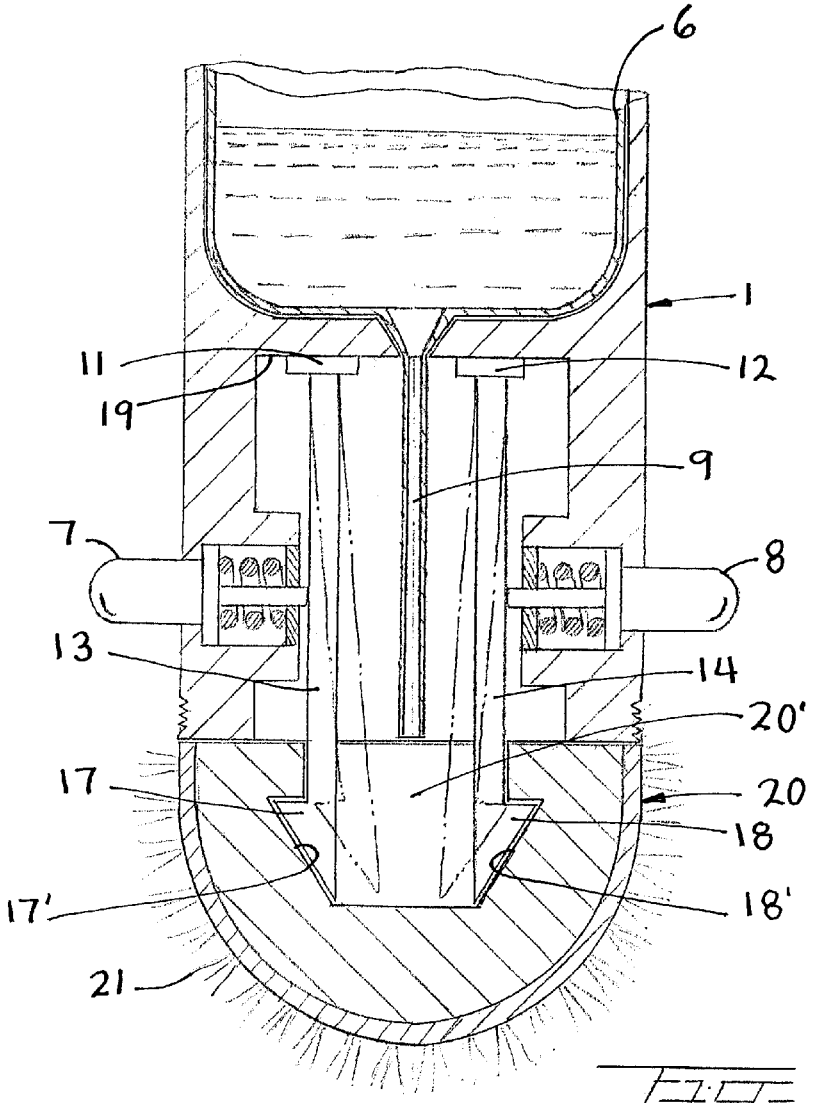
FIG. 4 is a representation of a cross-sectional view of one of the preferred embodiments showing the engagement mechanism for connecting the cleaning member.

As seen in FIG. 3, cleaning member 20 has a hemispherical shape with central opening 20' starting on flat surface 22. Member 20 is preferably made out of a biodegradable material, such as special type of biodegradable papers or fibers. The outer convex surfaces of member 20 includes irregularities, such as short bristles 21, intended to act as a brush on surfaces being cleaned. The preferred embodiment shows in FIG. 3 bristles mounted in orifices but other equivalent irregularities can be formed also.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cleaning brush, comprising:

A) a handle assembly having an elongated and cylindrical shape, having first and second ends and a hollow interior defining a space, said handle assembly includes first and second cover means mounted on said first and second ends respectively, and said handle assembly further including cooperatively disposed openings to permit a user to selectively press said flexible container means thereby causing said liquid to be dispensed;

B) flexible container means housed within said spaces said container means having a cleaning liquid and further including means for dispensing said liquid;

C) a cleaning member mounted to said first end; and

D) means for removably engaging said cleaning member said means for removally engaging said cleaning member includes two elongated stems each having a base end rigidly mounted to said first end and a distal end terminated with an arrow head, said stems extending longitudinally and in parallel spaced apart relationship with respect to each other, and further including button means for selectively deflecting said stems, and cleaning member including a cooperative opening for releasably receiving said arrow heads.

2. The cleaning brush set forth in claim 1 wherein said cooperative opening extends inwardly in said cleaning member and ends with an enlarged opening that cooperatively receives said arrowheads.

3. The cleaning brush set forth in claim 2 wherein said cleaning member has a substantially hemispherical shape with a convex area that includes a plurality of bristles.

4. A cleaning brush, comprising:

A) a handle assembly having an elongated and cylindrical shape, having first and second ends and a hollow interior defining a space, said handle assembly further including first and second apertures exposing said space;

B) flexible container means housed within said space, said container means having a cleaning liquid and further including cannula means for dispensing said liquid upon the deformation of said flexible container means by a user inserting his/her fingers through said first and second apertures;

C) a biodegradable cleaning member having a hemispherical shape with a convex surface including a plurality of irregularities and a flat surface opposite said convex surface, and further including an opening; and D) means for removably engaging said cleaning member to said first end and including two parallel and spaced apart stems that extend longitudinally from said first end, said stems including headed terminations for cooperatively and releasably engaging to said cleaning member within said opening and further including actuating means for deflecting said stems thereby disengaging them from said opening.

5. The cleaning brush set forth in claim 4, further including first cover means for closing said second end and said container means has an open end for receiving refills of said cleaning liquid.

6. The cleaning brush set forth in claim 5 further including a second cover means for closing said first end.

7. The cleaning brush set forth in claim 6 wherein said actuating means is spring loaded.

8. The cleaning brush set forth in claim 7 wherein said cleaning member is made out of a biodegradable material.

* * * * *